US006390784B1

(12) United States Patent
Kawaguchi et al.

(10) Patent No.: US 6,390,784 B1
(45) Date of Patent: May 21, 2002

(54) SOLENOID PROTECTOR FOR A VARIABLE DISPLACEMENT COMPRESSOR

(75) Inventors: Masahiro Kawaguchi; Ken Suitou; Masanori Sonobe; Hiroshi Kubo, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 08/896,888

(22) Filed: Jul. 18, 1997

(30) Foreign Application Priority Data

Jul. 22, 1996 (JP) ..... 8-191985

(51) Int. Cl.[7] ..... F04B 1/26
(52) U.S. Cl. ..... 417/222.2; 417/270
(58) Field of Search ..... 417/222.1, 222.2, 417/270

(56) References Cited

U.S. PATENT DOCUMENTS

| | | | | |
|---|---|---|---|---|
| 4,132,086 A | * | 1/1979 | Kountz | 62/209 |
| 4,345,564 A | * | 8/1982 | Kawamura et al. | 123/490 |
| 4,643,653 A | | 2/1987 | Masaka et al. | |
| 4,848,101 A | | 7/1989 | Suzuki | 62/228.5 |
| 4,924,031 A | | 5/1990 | Arai | |
| 5,036,422 A | * | 7/1991 | Uchida et al. | 361/159 |
| 5,145,326 A | * | 9/1992 | Kimura et al. | 417/222.2 |
| 5,558,122 A | * | 9/1996 | Kawamura et al. | 137/596.17 |
| 5,713,725 A | * | 2/1998 | Kawaguchi et al. | 417/222.2 |
| 5,842,835 A | * | 12/1998 | Kawaguchi et al. | 417/222.2 |
| 5,865,604 A | * | 2/1999 | Kawaguchi et al. | 417/222.2 |
| 6,033,189 A | * | 3/2000 | Miura et al. | 417/222.2 |

FOREIGN PATENT DOCUMENTS

| | | | |
|---|---|---|---|
| EP | 0 628 722 A1 | 12/1992 | 417/222.2 |
| JP | 3-111676 A * | 5/1991 | 417/222.1 |

OTHER PUBLICATIONS

Avallone et al., Marks' Standard Handbook for Mechanical Engineers, Nineth Edition, pp 15–82 and 15–84, Jun. 1987.*

* cited by examiner

*Primary Examiner*—Cheryl J. Tyler
(74) *Attorney, Agent, or Firm*—Morgan & Finnegan, LLP

(57) ABSTRACT

A compressor has a swash plate located in a crank chamber and tiltably mounted on a drive shaft. A piston is operably coupled to the swash plate and is located in a cylinder bore. The inclination of the swash plate is varied according to the difference between the pressure in the crank chamber and the pressure in the cylinder bore. The compressor has a supply passage for connecting a discharge chamber with the crank chamber. A control valve is located in the supply passage for adjusting the amount of the gas introduced into the crank chamber from the discharge chamber through the supply passage. The control valve includes a valve body and a solenoid selectively excited and de-excited based on a supply of electric current from a driver to actuate the valve body. The solenoid generates a counter-electromotive force based on the self-inductance of the solenoid when the solenoid is de-excited. A protector, such as a diode, is connected in parallel with the solenoid. The protector passes the current based on the counter-electromotive force therethrough to prevent the current based on the counter-electromotive force from being supplied to the driver.

26 Claims, 4 Drawing Sheets

SOLENOID PROTECTOR FOR A VARIABLE DISPLACEMENT COMPRESSOR

BACKGROUND OF THE INVENTION

1. Field of the Invention

The present invention relates to variable displacement compressors that are used in vehicle air conditioners. More particularly, the present invention relates to a variable displacement compressor equipped with a displacement control valve that controls the inclination of a swash plate.

2. Description of the Related Art

A typical variable displacement compressor has a swash plate tiltably supported on a rotary shaft. The inclination of the swash plate is controlled based on the difference between the pressure in a crank chamber and the pressure in the cylinder bores. The stroke of each piston is varied in accordance with the inclination of the swash plate. The displacement of the compressor is varied, accordingly. The compressor is provided with a discharge chamber that is connected to the crank chamber by a supply passage. A displacement control valve is located in the supply passage. The control valve controls the flow rate of refrigerant gas from the discharge chamber to the crank chamber thereby controlling the pressure in the crank chamber. Accordingly, the difference between the pressure in the crank chamber and the pressure in the cylinder bores is varied.

The control valve includes a valve body for controlling the opening of the supply passage and a solenoid for actuating the valve body. The solenoid is connected to a driver that is controlled by a controller. The controller causes the driver to selectively excite or de-excite the solenoid in accordance with conditions of the compressor such as cooling load. Exciting and de-exciting of the solenoid permit the valve body to control the opening of the supply passage. The flow rate of refrigerant gas from the discharge chamber to the crank chamber is controlled, accordingly.

De-exciting the solenoid of the control valve from an excited state generates an electromotive force based on the self-inductance of the solenoid. The electromotive force is oriented in a direction preventing the magnetic flux that passes through the solenoid from changing and is called a counter-electromotive force. If an excessive current is generated by the counter-electromotive force, the current applies an excessive load to the driver. This may result in the driver malfunctioning.

SUMMARY OF THE INVENTION

Accordingly, it is an objective of the present invention to provide a variable displacement compressor that prevents a current generated by a counter-electromotive force of the solenoid in the displacement control valve from being supplied to the driver.

To achieve the above objective, the compressor according to the present invention has a drive plate located in a crank chamber and tiltably mounted on a drive shaft and a piston operably coupled to the drive plate and located in a cylinder bore. The drive plate converts the rotation of the drive shaft to reciprocating movement of the piston in the cylinder bore. The piston compresses gas supplied to the cylinder bore from a suction chamber and discharges the compressed gas to a discharge chamber from the cylinder bore. The inclination of the drive plate is variable according to a difference between the pressure in the crank chamber and the pressure in the cylinder bore. The piston moves by a stroke determined by the inclination of the drive plate to control the displacement of the compressor. The compressor further includes means for adjusting the difference between the pressure in the crank chamber and the pressure in the cylinder bore. The adjusting means includes a gas passage for conducting gas used for adjusting the pressure and a control valve for adjusting the amount of the gas flowing in the gas passage. The control valve includes a valve body for adjusting the opening size of the gas passage and a solenoid selectively excited and de-excited based on a supply of electric current to actuate the valve body. The solenoid generates a counter-electromotive force based on the self-inductance of the solenoid when the solenoid is de-excited. A protector is connected in parallel with the solenoid to pass the current based on the counter-electromotive force generated in the solenoid through the protector.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

A variable displacement compressor according to a first embodiment of the present invention will now be described with reference to FIGS. 1 to 4.

Figure 1:
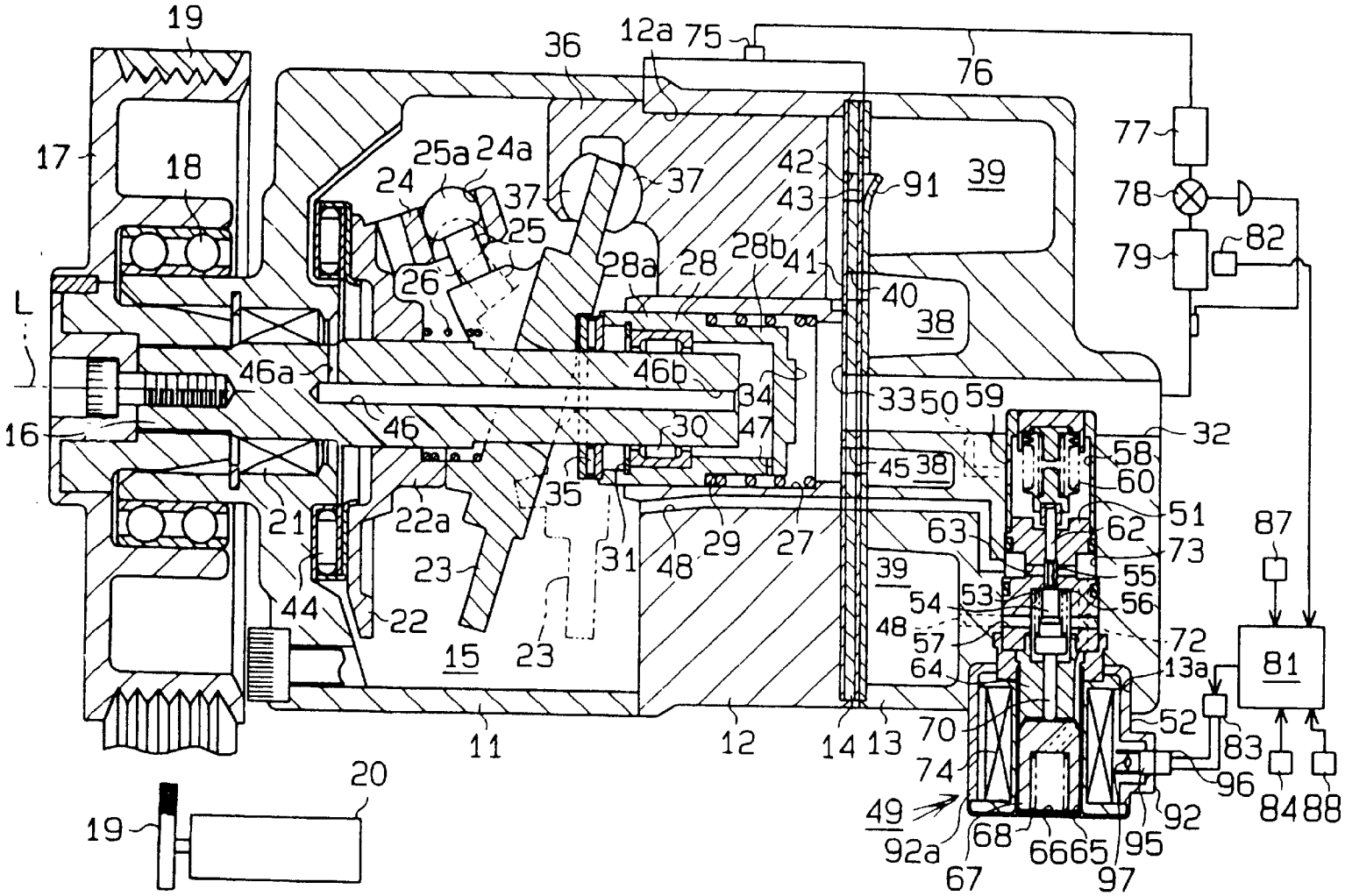
FIG. 1 is cross-sectional view illustrating a variable displacement compressor according to a first embodiment of the present invention.

As shown in FIG. 1, a cylinder block 12 constitutes a part of the compressor housing. A front housing 11 is secured to the front end face of the cylinder block 12. A rear housing 13 is secured to the rear end face of the cylinder block 12 with a valve plate 14 in between. A crank chamber 15 is defined by the inner walls of the front housing 11 and the front end face of the cylinder block 12.

A rotary shaft 16 is rotatably supported in the front housing 11 and the cylinder block 12. The front end of the rotary shaft 16 protrudes from the crank chamber 15 and is secured to a pulley 17. The pulley 17 is directly coupled to an external drive source (a vehicle engine 20 in this embodiment) by a belt 19. The compressor of this embodiment is a clutchless type variable displacement compressor having no clutch between the rotary shaft 16 and the external drive source. The pulley 17 is supported by the front housing 11 with an angular bearing 18.

A lip seal 21 is located between the rotary shaft 16 and the front housing 11 for sealing the crank chamber 15. The lip seal 21 prevents the gas in the crank chamber 15 from leaking.

A substantially disk-like swash plate 23 is supported by the rotary shaft 16 in the crank chamber 15 to be slidable along and tiltable with respect to the axis L of the shaft 16. The swash plate 23 is provided with a pair of guiding pins 25, each having a guide ball 25*a* at the distal end and being fixed to the swash plate 23. A rotor 22 is fixed to the rotary shaft 16 in the crank chamber 15. The rotor 22 rotates integrally with the rotary shaft 16. The rotor 22 has a support arm 24 protruding toward the swash plate 23. A pair of guide holes 24*a* are formed in the support arm 24. Each guide pin 25 is slidably fitted into the corresponding guide hole 24*a*. The cooperation of the arm 24 and the guide pins 25 permits the swash plate 23 to rotate together with the rotary shaft 16. The cooperation also guides the tilting of the swash plate 23 and the movement of the swash plate 23 along the axis L of the rotary shaft 16. As the swash plate 23 slides rearward toward the cylinder block 12, the inclination of the swash plate 23 decreases.

A coil spring 26 is located between the rotor 22 and the swash plate 23. The spring 26 urges the swash plate 23 rearward, or in a direction decreasing the inclination of the swash plate 23. The rotor 22 is provided with a projection 22*a* on its rear end face. The abutment of the swash plate 23 against the projection 22*a* prevents the inclination of the swash plate 23 beyond the predetermined maximum inclination.

Figure 2A:
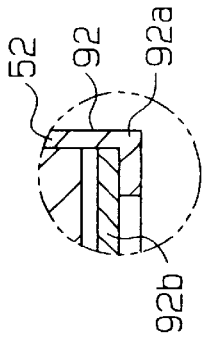
FIG. 2A is an enlarged partial cross-sectional view illustrating the window portion labeled 2A in the lower corner portion of FIG. 1.
Figure 2:
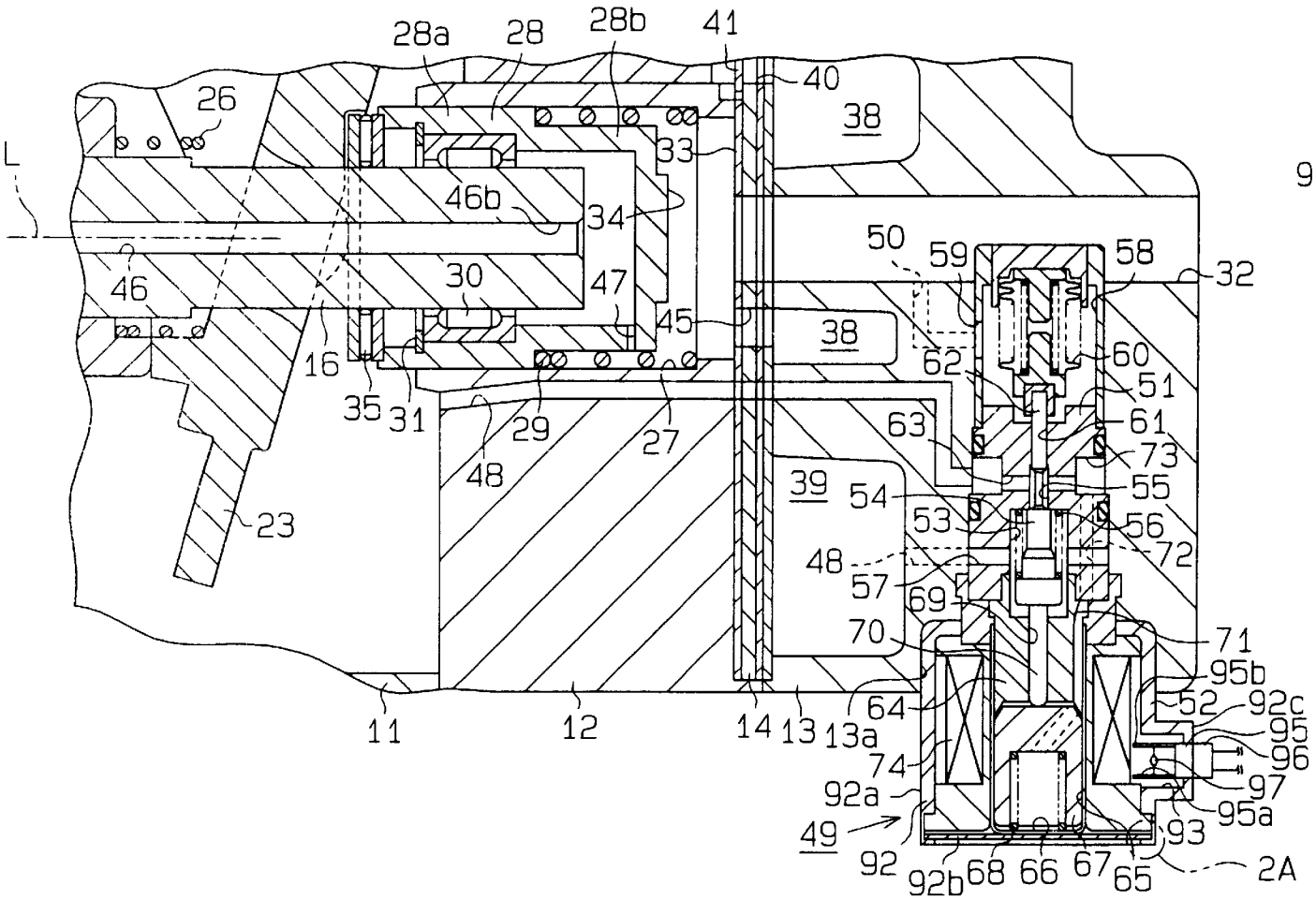
FIG. 2 is an enlarged partial cross-sectional view illustrating the compressor of FIG. 1 when the inclination of the swash plate is maximum.
Figure 3:
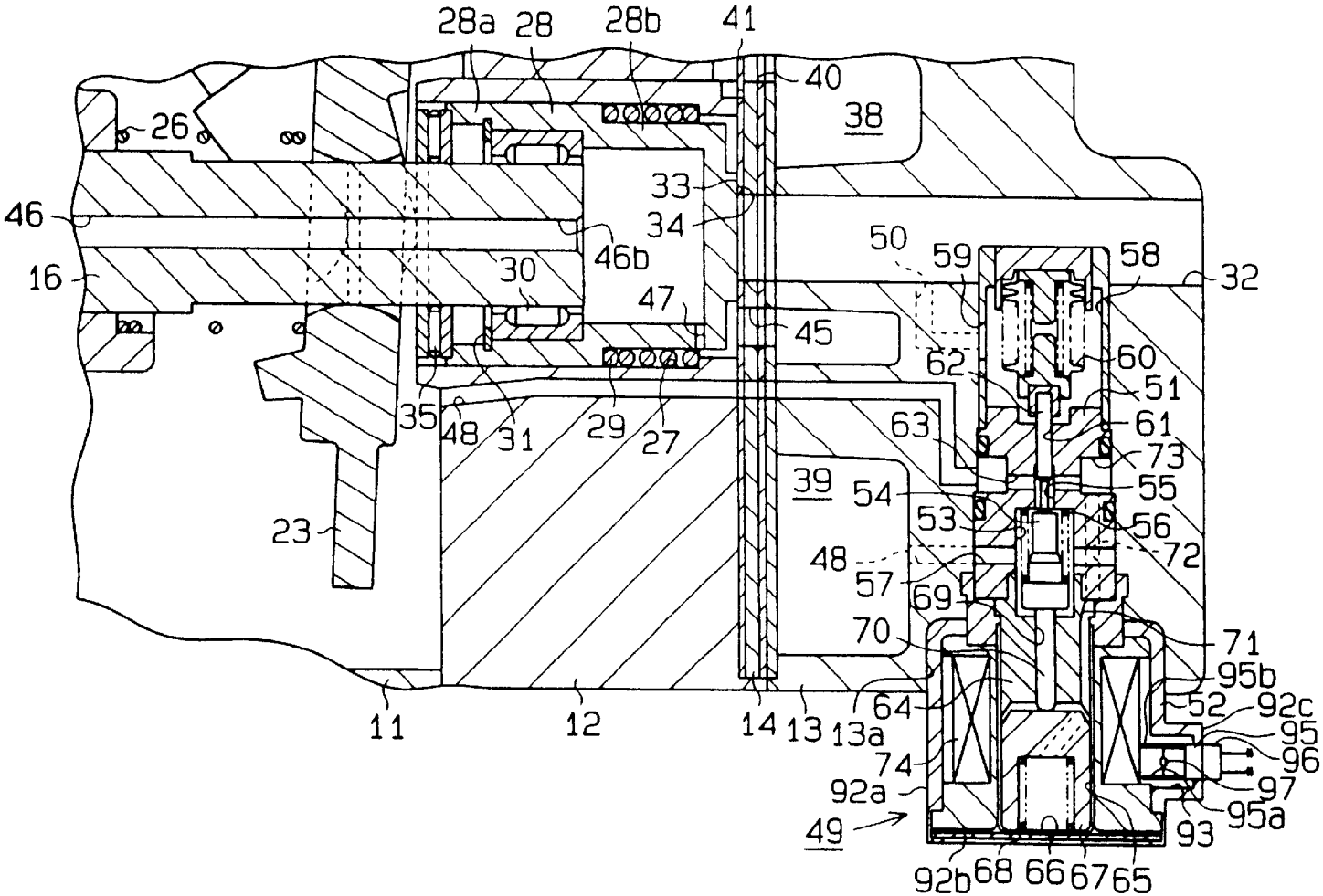
FIG. 3 is an enlarged partial cross-sectional view illustrating the compressor of FIG. 1 when the inclination of the swash plate is minimum.

As shown in FIGS. 1 to 3, a shutter chamber 27 is defined at the center portion of the cylinder block 12 extending along the axis L of the rotary shaft 16. A hollow cylindrical shutter 28 is accommodated in the shutter chamber 27. The shutter 28 slides along the axis L of the rotary shaft 16. The shutter 28 has a large diameter portion 28*a* and a small diameter portion 28*b*. A coil spring 29 is located between a step, which is defined by the large diameter portion 28*a* and the small diameter portion 28*b*, and a wall of the shutter chamber 27. The coil spring 29 urges the shutter 28 toward the swash plate 23.

The rear end of the rotary shaft 16 is inserted in the shutter 28. A radial bearing 30 is fixed to the inner wall of the large diameter portion 28*a* of the shutter 28 by a snap ring 31. Therefore, the radial bearing 30 moves with the shutter 28 along the axis L of the rotary shaft 16. The rear end of the rotary shaft 16 is supported by the inner wall of the shutter chamber 27 with the radial bearing 30 and the shutter 28 in between.

A suction passage 32 is defined at the center portion of the rear housing 13 and the valve plate 14. The passage 32 extends along the axis L of the rotary shaft 16 and is communicated with the shutter chamber 27. The suction passage 32 functions as a suction pressure area. A positioning surface 33 is formed on the valve plate 14 about the inner opening of the suction passage 32. The rear end of the shutter 28 functions as a shutting surface 34, which abuts against the positioning surface 33. Abutment of the shutting surface 34 against the positioning surface 33 prevents the shutter 28 from further moving rearward away from the rotor 22. The abutment also disconnects the suction passage 32 from the shutter chamber 27.

A thrust bearing 35 is supported on the rotary shaft 16 and is located between the swash plate 23 and the shutter 28. The thrust bearing 35 slides along the axis L of the rotary shaft 16. The force of the coil spring 29 constantly retains the thrust bearing 35 between the swash plate 23 and the shutter 28. The thrust bearing 35 prevents the rotation of the swash plate 23 from being transmitted to the shutter 28.

The swash plate 23 moves rearward as its inclination decreases. As it moves rearward, the swash plate 23 pushes the shutter 28 rearward through the thrust bearing 35. Accordingly, the shutter 28 moves toward the positioning surface 33 against the force of the coil spring 29. As shown in FIG. 3, when the shutting surface 34 of the shutter 28 abuts against the positioning surface 33, the swash plate 23 reaches the minimum inclination. In this state, the shutter 28 is located at the closed position for disconnecting the shutter chamber 27 from the suction passage 32.

A plurality of cylinder bores 12*a* extend through the cylinder block 12. The cylinder bores 12*a* extend parallel to the axis L of the rotary shaft 16, and are spaced apart at equal intervals about the axis L. A single-headed piston 36 is accommodated in each cylinder bore 12*a*. A pair of semispherical shoes 37 are fitted between each piston 36 and the swash plate 23. A semispherical portion and a flat portion are defined on each shoe 37. The semispherical portion slidably contacts the piston 36 while the flat portion slidably contacts the swash plate 23. The swash plate 23 is rotated by the rotary shaft 16 through the rotor 22. The rotating movement of the swash plate 23 is transmitted to each piston 36 through the shoes 37 and is converted to linear reciprocating movement of each piston 36 in the associated cylinder bore 12*a*.

A suction chamber 38 is defined in the center portion of the rear housing 13. The suction chamber 38 is communicated with the shutter chamber 27 via a communication hole 45. A discharge chamber 39 is defined about the suction chamber 37 in the rear housing 13. Suction ports 40 and discharge ports 42 are formed in the valve plate 14. Each suction port 40 and each discharge port 42 correspond to one of the cylinder bores 12*a*. Suction valve flaps 41 are formed on the valve plate 14. Each suction valve flap 41 corresponds to one of the suction ports 40. Discharge valve flaps 43 are formed on the valve plate 14. Each discharge valve flap 43 corresponds to one of the discharge ports 42.

As each piston 36 moves from the top dead center to the bottom dead center in the associated cylinder bore 12*a*, refrigerant gas in the suction chamber 38 is drawn into each cylinder bore 12*a* through the associated suction port 40 while causing the associated suction valve flap 41 to flex to an open position. As each piston 36 moves from the bottom dead center to the top dead center in the associated cylinder bore 12*a*, refrigerant gas is compressed in the cylinder bore 12*a* and discharged to the discharge chamber 39 through the associated discharge port 42 while causing the associated discharge valve flap 43 to flex to an open position. Retainers 91 are formed on the valve plate 14. Each retainer 91 corresponds to one of the discharge valve flaps 43. The opening amount of each discharge valve flap 43 is defined by contact between the valve flap 43 and the associated retainer 91.

A thrust bearing 44 is located between the front housing 11 and the rotor 22. The thrust bearing 44 carries the reactive force of gas compression acting on the rotor 22 through the pistons 36 and the swash plate 23.

A pressure release passage 46 is defined at the center portion of the rotary shaft 16. The pressure release passage 46 has an inlet 46*a*, which opens to the crank chamber 15 in the vicinity of the lip seal 21, and an outlet 46*b* that opens in the interior of the shutter 28. A pressure release hole 47 is formed in the peripheral wall near the rear end of the shutter 28. The hole 47 communicates the interior of the shutter 28 with the shutter chamber 27.

A supply passage 48 is defined in the rear housing 13, the valve plate 14 and the cylinder block 12 for communicating the discharge chamber 39 with the crank chamber 15. A displacement control valve 49 is accommodated in the rear housing 13 in the supply passage 48. A pressure introduction passage 50 is defined in the rear housing 13 for communicating the control valve 49 with the suction passage 32.

As shown in FIGS. 1 to 3, the control valve 49 includes a housing 51 and the solenoid 52, which are secured to each other. A valve accommodating hole 13*a* is formed in the rear housing 13. The control valve 49 is fitted in the hole 13*a*. More specifically, the entire housing 51 and the upper portion of the solenoid 52 are accommodated in the hole 13*a*. The solenoid 52 is provided with a protection case 92 for covering the whole outer surface of the solenoid 52. Therefore, the part of the solenoid 52 that is exposed to the outside of the rear housing 13 is covered and protected by the case 92. The case 92 includes a cylinder 92*a* and a lid 92*b* (FIG. 2) for closing the lower opening of the cylinder 92*a*. As illustrated in FIG. 2 and FIG. 2A, the lower edge of the cylinder 92*a* is bent inward with the lid 92*b* located at the lower opening of the cylinder 92*a*. This retains the lid 92*b* in the cylinder 92*a*.

A valve chamber 53 is defined between the housing 51 and the solenoid 52. The valve chamber 53 is connected to the discharge chamber 39 by a first port 57 and the supply passage 48. A valve body 54 is arranged in the valve chamber 53. A valve hole 55 is defined extending axially in the housing 51 and opens in the valve chamber 53. A first coil spring 56 extends between the valve body 54 and a wall of the valve chamber 53 for urging the valve body 54 in a direction opening the valve hole 55.

A pressure sensing chamber 58 is defined at the upper portion of the housing 51. The pressure sensing chamber 58 is provided with a bellows 60 and is connected to the suction passage 32 by a second port 59 and the pressure introduction passage 50. A first guide hole 61 is defined in the housing 51 between the pressure sensing chamber 58 and the valve hole 55. The bellows 60 is connected to the valve body 54 by a first rod 62. The first rod 62 has a small diameter portion, which extends through the valve hole 55. A clearance between the small diameter portion of the rod 62 and the valve hole 55 permits the flow of refrigerant gas.

A third port 63 is defined in the housing 51 between the valve chamber 53 and the pressure sensing chamber 58. The third port 63 extends transversely to and intersects the valve hole 55. The valve hole 55 is connected to the crank chamber 15 by the third port 63 and the supply passage 48. Thus, the first port 57, the valve chamber 53, the valve hole 55 and the third port 63 constitute a part of the supply passage 48. The third port 63, the valve hole 55, the valve chamber 53, and the first port 57 form a gas passage that is used along with the control valve 49, for adjusting the pressure difference between the pressure in the crank chamber and the pressure in the cylinder bore.

An accommodating hole 65 is defined in the center portion of the solenoid 52. A fixed steel core 64 is fitted in the upper portion of the hole 65. A plunger chamber 66 is defined by the fixed core 64 and inner walls of the hole 65 at the lower portion of the hole 65 in the solenoid 52. A cylindrical plunger 67 is accommodated in the plunger chamber 66. The plunger 67 slides along the axis of the chamber 66. A second coil spring 68 extends between the plunger 67 and the bottom of the hole 65. The force of the second coil spring 68 is smaller than the force of the first coil spring 56. A second guide hole 69 is defined in the fixed core 54 between the plunger chamber 66 and the valve chamber 53. A second rod 70 is formed integrally with the valve body 54 and projects downward from the bottom of the valve body 54. The second rod 70 is accommodated in and slides with respect to the second guide hole 69. The first spring 56 urges the valve body 54 downward, while the second spring 68 urges the plunger:67 upward. This allows the lower end of the second rod 70 to constantly contact the plunger 67. In other words, the valve body 54 moves integrally with the plunger 67 with the second rod 70 in between.

A small chamber 73 is defined by the inner wall of the rear housing 13 and the circumference of the valve 49 at a position corresponding to the third port 63. The small chamber 73 is communicated with the valve hole 55 by the third port 63. A communication groove 71 is formed in a side of the fixed core 64,.and opens in the plunger chamber 66. A communication passage 72 is formed in the middle portion of the housing 51 for communicating the groove 71 with the small chamber 73. The plunger chamber 66 is connected to the valve hole 55 by the groove 71, the passage 72, the chamber 73, and the third port 63. Therefore, the pressure in the plunger chamber 66 is equalized with the pressure in the valve hole 55 (or the pressure in the crank chamber 15).

A cylindrical coil 74 is wound about the core 64 and the plunger 67. A supporting portion 92*c* is formed by a part of the cylinder 92*a* of the case 92 that projects outward. A connector chamber 93 is defined in the supporting portion 92*c*. A first connector 95 is fixed in the supporting portion 92*c*. The first connector 95 has a plus terminal 95*a* and a minus terminal 95*b* located in the connector chamber 93. The plus terminal 95*a* is connected to an end of the coil 74, while the minus terminal 95*b* is connected to the other end of the coil 74. A computer 81 and a driver 83 are separately provided from the compressor. The driver 83 is connected to a second connector 96. The second connector 96 detachably connects the driver 83 with the first connector 95. The driver 83 controls electric current supplied to the coil 74 using electricity provided, for example, from a vehicle battery (not shown) based on commands from the computer 81. Since the driver 83 and the control valve 49 are detachably connected by the connectors 95 and 96, the compressor, and the computer 81 and the driver 83 for controlling the compressor can be separately installed in the vehicle and be then connected to one another.

Figure 4:
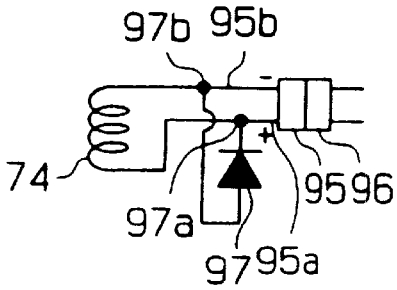
FIG. 4 is a circuit diagram illustrating a protector.

A diode 97 is provided in the connector chamber 93. As shown in FIG. 4, the diode 97 has a cathode 97*a*, which is connected to the plus terminal 95*a* of the first connector 95, and an anode 97*b*, which is connected to the minus terminal 95*b* of the first connector 95. In other words, the diode 97 is connected in parallel with the coil 74. The diode 97 functions as a protector for protecting the driver 83.

An outlet port 75 is formed in the cylinder block 12 and is communicated with the discharge chamber 39. The outlet port 75 is connected to the suction passage 32 by an external refrigerant circuit 76. The refrigerant circuit 76 includes a condenser 77, an expansion valve 78 and an evaporator 79. The compressor, the condenser 77, the expansion valve 78 and the evaporator 79 make up an air conditioner.

The computer 81 is connected to various devices including a temperature sensor 82, a compartment temperature sensor 84, an air conditioner starting switch 87 and a temperature adjuster 88. The temperature sensor 82 is located in the vicinity of the evaporator 79 for detecting the temperature of the evaporator 79. The compartment temperature sensor 84 detects the temperature in the vehicle passenger compartment. A passenger sets a desirable compartment temperature, or a target temperature, by the temperature adjuster 88. The computer 81 computes a duty ratio based on various data including a target temperature set by the temperature adjuster 88, a temperature detected by the temperature sensor 82, a compartment temperature detected by the temperature sensor 84, an ON/OFF signal from the air conditioner starting switch 87. The computer 81 then transmits the computed duty ratio to the driver 83. The driver 83 uses the electromotive force supplied from a vehicle battery for transmitting a current, the fluctuations of which correspond to the inputted duty ratio, to the coil 74 of the control valve 49. Accordingly, the solenoid 52 of the valve 49 is repeatedly excited and de-excited in accordance with the duty ratio.

The operation of the above described compressor will hereafter be described.

When the switch 87 is turned on, if the compartment temperature detected by the temperature sensor 84 is equal to or greater than a value set by the temperature adjuster 88, the computer 81 commands the driver 83 to excite solenoid 52. Specifically, the computer 81 transmits a predetermined duty ratio, which is greater than 0%, to the driver 83. The driver 83 supplies a current, the fluctuations of which correspond to the inputted duty ratio to the coil 74 of the solenoid 52. The greater the duty ratio becomes, the greater the average value of the current to the coil 74 becomes. Contrarily, the smaller the duty ratio, the smaller the average value of the current to the coil 74 becomes.

Supplying the current to the coil 74 produces a magnetic attractive force in accordance with the current magnitude between the core 64 and the plunger 67. The attractive force is transmitted to the valve body 54 by the second rod 70, and thus urges the valve body 54 against the force of the first spring 56 in a direction closing the valve hole 55. On the other hand, the length of the bellows 60 changes in accordance with the suction pressure in the suction passage 32 that is introduced to the pressure sensing chamber 58 via the passage 50. The changes in the length of the bellows 60 are transmitted to the valve body 54 by the first rod 62. The higher the suction pressure is, the shorter the bellows 60 becomes. As the bellows 60 becomes shorter, the bellows 60 pulls the valve body 54 in a direction closing the valve hole 55.

The opening area between the valve, body 54 and the valve hole 55 is determined by the equilibrium of a plurality of forces acting on the valve body 54. Specifically, the opening area is determined by the equilibrium position of the body 54, which is affected by the force of the solenoid 52, the force of the bellows 60, the force of the first spring 56, the force of the second spring 68.

Suppose the cooling load is great and the temperature in the vehicle compartment detected by the sensor 84 is significantly higher than a target temperature set by the temperature adjuster 88. The computer 81 sets a higher duty ratio to be transmitted to the driver 83 for a greater difference between a detected compartment temperature and a target temperature. This increases the magnitude of the attractive force between the core 64 and the plunger 67 thereby increasing the resultant force urging the valve body 54 in a direction closing the valve hole 55. This lowers the required value of suction pressure for moving the valve body 54 in a direction closing the valve hole 55. Thus, the valve body 54 controls the opening of the valve hole 55 based on a lower suction pressure. In other words, increasing the duty ratio causes the valve 49 to maintain a lower suction pressure (which is equivalent to a target pressure).

A smaller opening area between the valve body 54 and the valve hole 55 decreases the amount of refrigerant gas flow from the discharge chamber 39 to the crank chamber 15 via the supply passage 48. The refrigerant gas in the crank chamber 15 flows into the suction chamber 38 via the pressure release passage 46 and the pressure release hole 47. This lowers the pressure in the crank chamber 15. Further, when the cooling load is great, the suction pressure is high. Accordingly, the pressure in each cylinder bore 12*a* is high. Therefore, the difference between the pressure in the crank chamber 15 and the pressure in each cylinder bore 12*a* is small. This increases the inclination of the swash plate 23, thereby causing the compressor to operate at a larger displacement.

When the valve hole 55 in the control valve 49 is completely closed by the valve body 54, the supply passage 48 is closed. This stops the supply of the highly pressurized refrigerant gas in the discharge chamber 39 to the crank chamber 15. Therefore, the pressure in the crank chamber 15 becomes substantially the same as a low pressure in the suction chamber 38. The inclination of the swash plate 23 thus becomes maximum as shown in FIGS. 1 and 2, and the compressor operates at the maximum displacement.

Suppose the cooling load is small, the difference between the passenger compartment temperature detected by the sensor 84 and a target temperature set by the temperature adjuster 88 is small. The computer 81 sets a lower duty ratio to be transmitted to the driver 83 for a smaller difference between a detected compartment temperature and a target temperature. This decreases the magnitude of the attractive force between the core 64 and the plunger 67 thereby decreasing the resultant force urging the valve body 54 in a direction closing the valve hole 55. This increases the required value of suction pressure for moving the valve body 54 in a direction closing the valve hole 55. Thus, the valve body 54 controls the opening of the valve hole 55 with a higher suction pressure. In other words, decreasing the duty ratio causes the valve 49 to maintain a higher suction pressure (which is equivalent to a target pressure).

A larger opening area between the valve body 54 and the valve hole 55 increases the amount of refrigerant gas flow from the discharge chamber 39 to the crank chamber 15. This increases the pressure in the crank chamber 15. Further, when the cooling load is small, the suction pressure is low. Accordingly, the pressure in each cylinder bore 12*a* is low. Therefore, the difference between the pressure in the crank chamber 15 and the pressure in each cylinder bore 12*a* is great. This decreases the inclination of the swash plate 23, thereby allowing the compressor to operate at a small displacement.

As the cooling load approaches zero, the temperature of the evaporator 79 in the refrigerant circuit 76 drops to a frost forming temperature. When the temperature sensor 82 detects a temperature that is lower than the frost forming temperature, the computer 81 changes the duty ratio, which is transmitted to the driver 83, to 0% thereby de-exciting the solenoid 52. The driver 83 stops sending current to the coil 74, accordingly. This eliminates the magnetic attractive force between the core 64 and the plunger 67. The valve body 54 is then moved in a direction opening the valve hole 55 by the force of the first spring 56 against the force of the second spring 68 transmitted by the plunger 67 and the second rod 70. This maximizes the opening area between the valve body 54 and the valve hole 55. Thus, the gas flow from the discharge chamber 39 to the crank chamber 15 is increased. This further raises the pressure in the crank chamber 15 thereby minimizing the inclination of the swash plate 23 as shown in FIG. 3. The compressor thus operates at the minimum displacement.

When the switch 87 is turned off, the computer 81 commands the driver 83 to de-excite the solenoid 52. This also minimizes the inclination of the swash plate 23.

As described above, when the duty ratio is increased, the valve body 54 of the valve 49 allows the opening area of the valve hole 55 to be controlled by a lower suction pressure. When the duty ratio is decreased, on the other hand, the valve body 54 allows the opening area of the valve hole 55 to be controlled by a higher suction pressure. The compressor controls the inclination of the swash plate 23 to adjust its displacement thereby maintaining a target suction pressure. That is, the valve 49 changes a target value of the suction pressure in accordance with the duty ratio. A compressor equipped with the control valve 49 varies the refrigerant ability of the air conditioner.

The shutter 28 slides in accordance with the tilting motion of the swash plate 23. As the inclination of the swash plate 23 decreases, the shutter 28 gradually reduces the cross-sectional area of the passage between the suction passage 32 and the suction chamber 38. This gradually reduces the amount of refrigerant gas that enters the suction chamber 38 from the suction passage 32. The amount of refrigerant gas that is drawn into the cylinder bores 12*a* from the suction chamber 38 gradually decreases, accordingly. As a result, the displacement of the compressor gradually decreases. This gradually lowers the discharge pressure of the compressor. The load torque of the compressor thus gradually decreases. In this manner, the load torque for operating the compressor does not change dramatically in a short time when the displacement decreases from the maximum to the minimum. The shock that accompanies load torque fluctuations is therefore lessened.

When the inclination of the swash plate 23 is minimum, the shutter 28 abuts against the positioning surface 33. The abutment prevents the inclination of the swash plate 23 from being smaller than the predetermined minimum inclination. The abutment also disconnects the suction passage 32 from the suction chamber 38. This stops the gas flow from the refrigerant circuit 76 to the suction chamber 38 thereby stopping the circulation of refrigerant gas between the circuit 76 and the compressor.

The minimum inclination of the swash plate 23 is slightly larger than zero degrees. Zero degrees refers to the angle of the swash plate's inclination when it is perpendicular to the axis L of the rotary shaft 16. Therefore, even if the inclination of the swash plate 23 is minimum, refrigerant gas in the cylinder bores 12*a* is discharged to the discharge chamber 39 and the compressor operates at the minimum displacement. The refrigerant gas discharged to the discharge chamber 39 from the cylinder bores 12*a* is drawn into the crank chamber 15 through the supply passage 48. The refrigerant gas in the crank chamber 15 is drawn back into the cylinder bores 12*a* through the pressure release passage 46, a pressure release hole 47 and the suction chamber 38. That is, when the inclination of the swash plate 23 is minimum, refrigerant gas circulates within the compressor traveling through the discharge chamber 39, the supply passage 48, the crank chamber 15, the pressure release passage 46, the pressure release hole 47, the suction chamber 38 and the cylinder bores 12*a*. This circulation of refrigerant gas allows the lubricant oil contained in the gas to lubricate the moving parts of the compressor.

When the switch 87 is turned on and the inclination of the swash plate 23 is minimum, if the cooling load is increased by an increase in the compartment temperature, the compartment temperature detected by the sensor 84 becomes higher than a target temperature set by the temperature adjuster 88. The computer 81 commands the driver 83 to excite the solenoid 52 in accordance with the detected temperature increase in the same manner described above. When the solenoid 52 is excited, the supply passage 48 is closed. This stops the flow of refrigerant gas from the discharge chamber 39 into the crank chamber 15. The refrigerant gas in the crank chamber 15 flows into the suction chamber 38 via the pressure release passage 46 and the pressure release hole 47. This gradually lowers the pressure in the crank chamber 15 thereby moving the swash plate 23 from the minimum inclination to the maximum inclination.

As the swash plate's inclination increases, the force of the spring 29 gradually pushes the shutter 28 away from the positioning surface 33. This gradually increases the cross-sectional area of the passage between the suction passage 32 to the suction chamber 38 thereby gradually increasing the amount of refrigerant gas flow from the suction passage 32 into the suction chamber 38. Therefore, the amount of refrigerant gas drawn into the cylinder bores 12*a* from the suction chamber 38 gradually increases. This allows the displacement of the compressor to gradually increase. Thus, the discharge pressure of the compressor gradually increases and the torque needed for operating the compressor also gradually increases accordingly. In this manner, the load torque of the compressor does not change dramatically in a short time when the displacement increases from the minimum to the maximum. The shock that accompanies load torque fluctuations is therefore lessened.

If the engine 20 is stopped, the compressor is also stopped (that is, the rotation of the swash plate 23 is stopped). Also, the supply of current to the coil 74 in the valve 49 is stopped. This de-excites the solenoid 52 thereby opening the supply passage 48. The inclination of the swash plate 23 thus becomes minimum. If the nonoperational state of the compressor continues, the pressures in the chambers of the compressor become equalized but the swash plate 23 is kept at the minimum inclination by the force of spring 26. Therefore, when the engine 20 is started again, the compressor starts operating with the swash plate 23 at the minimum inclination. This requires only minimum torque. The shock caused by starting the compressor is thus reduced.

As described above, the driver 83 sends a current, the fluctuations of which correspond to a duty ratio transmitted from the computer 81, to the coil 74 of the control valve 49. The coil 74 is thus repeatedly excited and de-excited in accordance with the duty ratio. De-exciting the coil 74 from an excited state generates electromotive force based on the self-inductance of the coil 74. The electromotive force is oriented in a direction preventing the magnetic flux that passes through the solenoid 52 from changing and is called a counter-electromotive force. However, the current based on this counter-electromotive force is consumed when passing through a closed circuit formed between the coil 74 and the diode 97. The current is thus not supplied to the driver 83. The counter-electromotive force generated in the coil 74 therefore does not affect the driver 83. The durability and reliability of the driver 83 is thus improved. This results in improved durability and reliability of the entire air conditioner.

The diode 97 is inexpensive. The circuit for protecting the driver 83 can thus be fabricated inexpensively. This lowers the manufacturing cost of the compressor.

The diode 97 is accommodated in the case 92 of the control valve 49 such that the diode 97 is not directly exposed to the interior of the engine compartment of the vehicle. The engine compartment is a harsh environment for electric elements such as the diode 97. Accommodating the diode 97 in the case 92 therefore improves the durability and reliability of the protector including the diode 97.

The diode 97 is located in the control valve 49 of the compressor and the controllers including the computer 81 and the driver 83 are connected to the control valve 49 by the detachable connectors 95, 96. Therefore the protector constituted by the diode 97 is installed in an air conditioner without any alteration to the construction of existing controllers. Installment of the protector in a vehicle air conditioner is thus facilitated and inexpensive.

Figure 5:
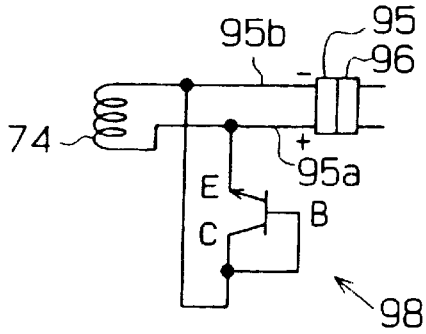
FIG. 5 is a circuit diagram illustrating a protector according to a second embodiment of the present invention.

The present invention may be alternatively embodied in the following forms:

In the preferred embodiment, the protector is constituted by the diode 97. However the protector may be constituted by other types of electric elements. For example, a protector according to a second embodiment illustrated in FIG. 5 is constituted by a bipolar transistor 98 instead of the diode 97. The transistor 98 is connected to the plus terminal 95*a* and the minus terminal 95*b* of the first connector 95. Specifically, the transistor 98 includes an emitter E, which is connected to the plus terminal 95*a,* and a base B and a collector C, which are connected to the minus terminal 95*b.*

Figure 6:
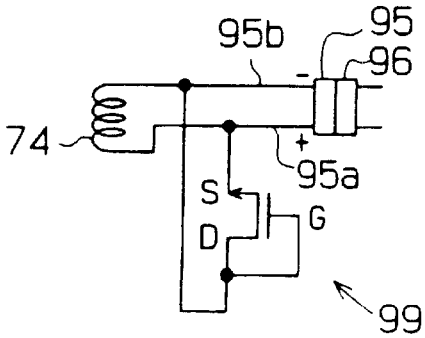
FIG. 6 is a circuit diagram illustrating a protector according to a third embodiment of the present invention.

A protector according to a third embodiment illustrated in FIG. 6 is constituted by an MOS transistor 99 instead of the diode 97. The transistor 99 is connected to the plus terminal 95*a* and the minus terminal 95*b* of the first connector 95. Specifically, the transistor 99 includes a source S, which is connected to the plus terminal 95*a,* and a gate G and a drain D, which are connected to the minus terminal 95*b.*

As in the first embodiment, the second and third embodiments cause the current generated by the counter-electromotive force be consumed when passing through the closed circuit formed between the coil 74 and the transistors 98 or 99. The current is thus not supplied to the driver 83.

In the first to third embodiments, the diode 97, the transistors 98, 99 may be located between the connectors 95, 96 and the driver 83.

In the compressor according to the first embodiment illustrated in FIG. 1, the displacement of the compressor is controlled by adjusting the amount of refrigerant gas supplied to the crank chamber 15 by the control valve 49. However, the displacement of the compressor may be controlled by other methods. For example, the displacement may be controlled by a control valve located in a passage extending from the crank chamber 15 to the suction chamber 38. The control valve adjusts the amount of refrigerant gas discharged from the crank chamber 15 to the suction chamber 38 for controlling the displacement. Alternatively, the displacement may be controlled by a control valve located in a passage connecting the crank chamber 15 with the discharge chamber 39 and in a passage connecting the suction chamber 38 with the crank chamber 15. The control valve adjusts the amount of refrigerant gas supplied to the crank chamber 15 as well as the amount of refrigerant gas discharged from the crank chamber 15 for controlling the displacement.

In the compressor according to the first embodiment illustrated in FIG. 1, the displacement is controlled by adjusting the pressure in the crank chamber 15. However, the displacement may be controlled by adjusting the pressure in the cylinder bores 12*a* by changing the amount of refrigerant gas supplied to the suction chamber 38.

The present invention may be embodied in a clutch type variable displacement compressor.

Therefore the present examples and embodiments are to be considered as illustrative and not restrictive and the invention is not to be limited to the details given herein but may be modified within the scope of the appended claims.

What is claimed is:

1. A compressor comprising a drive plate located in a crank chamber and tiltably mounted on a drive shaft and a piston operably coupled to the drive plate and located in a cylinder bore, wherein, during operation, the drive plate converts the rotation of the drive shaft to reciprocating movement of the piston in the cylinder bore, the piston compresses gas supplied to the cylinder bore from a suction chamber and discharges the compressed gas to a discharge chamber from the cylinder bore, the inclination of the drive plate is variable according to a difference between the pressure in the crank chamber and the pressure in the cylinder bore, and the piston moves by a stroke determined by the inclination of the drive plate to control the displacement of the compressor, the compressor further comprising:

means for adjusting the difference between the pressure in the crank chamber and the pressure in the cylinder bore, wherein the adjusting means includes a gas passage for conducting gas to adjust the pressure and a control valve for adjusting the amount of the gas flowing in the gas passage;

wherein the control valve comprises a valve body for adjusting the opening size of the gas passage and a solenoid selectively excited and de-excited based on a supply of electric current to actuate the valve body, wherein the solenoid generates a counter-electromotive force based on the self-inductance of the solenoid when the solenoid is de-excited;

means for supplying the current to the solenoid;

a first detachable connector having a plus and a minus terminal electrically connected to the solenoid;

a protector electrically connected in parallel with the plus and the minus terminal of the first detachable connector and with the solenoid to pass the current based on the counter-electromotive force generated in the solenoid through the protector to prevent the current based on the counter-electromotive force from being supplied to the supplying means; and a second detachable connector electrically connected to the supplying means for detachably connecting the supplying means to the first detachable connector.

2. The compressor according to claim 1, wherein the protector includes a diode.

3. The compressor according to claim 2, wherein the solenoid has a first end and a second end, and the diode is connected between the first end and the second end to prevent the current from the supplying means from passing through the diode and to allow the current based on the counter-electromotive force to pass through the diode.

4. The compressor according to claim 1, wherein the protector includes a transistor.

5. The compressor according to claim 4, wherein the solenoid has a first end and a second end, and the transistor includes an emitter that is connected to the first end and a base and a collector that are connected to the second end to prevent the current from the supplying means from passing through the transistor and to allow the current based on the counter-electromotive force to pass through the transistor.

6. The compressor according to claim 4, wherein the solenoid has a first end and a second end, and the transistor includes a source that is connected to the first end and a gate and a drain that are connected to the second end to prevent the current from the supplying means from passing through the transistor and to allow the current base on the counter-electromotive force to pass through the transistor.

7. The compressor according to claim 1, wherein the control valve has a protection case for covering the solenoid, and the protector is located in the protecting case.

8. The compressor according to claim 1, wherein the protector is located between the first detachable connector and the solenoid.

9. The compressor according to claim 1, wherein the gas passage includes a supply passage for connecting the discharge chamber with the crank chamber, and the control valve is located in the supply passage for adjusting the amount of the gas introduced into the crank chamber from the discharge chamber through the supply passage to control the pressure in the crank chamber.

10. The compressor according to claim 1 further comprising a computer for computing a duty ratio based on the operation state of the compressor, wherein the supplying means supplies the current, which varies a fluctuation in accordance with the duty ratio computed by the computer, to the solenoid.

11. A compressor comprising a drive plate located in a crank member and mounted on a drive shaft and a piston operably coupled to the drive plate and located in a cylinder bore, wherein, during operation, the drive plate converts the rotation of the drive shaft to reciprocating movement of the piston in the cylinder bore, the piston compresses gas supplied to the cylinder bore from a separate external circuit by way of a suction chamber and discharges the compressed gas to the external circuit from the cylinder bore by way of a discharge chamber, the drive plate inclines between a maximum inclination position and a minimum inclination position according to a difference between the pressure in the crank chamber and the pressure in the cylinder bore, and the piston moves by a stroke determined by the inclination of the drive plate to control the displacement of the compressor, the compressor comprising:

means for adjusting the pressure difference between the pressure in the crank chamber and the pressure in the cylinder bore, wherein the adjusting means includes a gas passage for conducting gas to adjust the pressure difference and a control valve for adjusting the amount of the gas flowing in the gas passage;

wherein the control valve comprises a valve body for adjusting the opening size of the gas passage, a solenoid selectively excited and de-excited based on a supply of electric current to actuate the valve body, and a protection case for covering the solenoid, wherein the solenoid generates a counter-electromotive force based on the self-inductance of the solenoid when the solenoid is de-excited;

means for supplying the current to the solenoid;

a first detachable connector having a plus and a minus terminal electrically connected to the solenoid;

a second detachable connector electrically connected to the supplying means for detachably connecting the supplying means to the first detachable connector; and a protector electrically connected in parallel with the plus and minus terminals of the first detachable connector and with the solenoid, wherein the protector conducts a current based on the counter-electromotive force to prevent the current based on the counter-electromotive force from being supplied to the supplying means, and the protector is within the protection case, between the first detachable connector and a coil of the solenoid.

12. The compressor according to claim 11, wherein the solenoid has a first terminal and a second terminal, and the transistor includes an emitter, connected to the second terminal, to prevent the current from the supplying means from passing through the transistor and to allow the current based on the counter-electromotive force to pass through the transistor.

13. The compressor according to claim 11, wherein the protector includes a transistor.

14. The compressor according to claim 13, wherein the solenoid has a first end and a second end, wherein the transistor includes an emitter that is connected to the first end and a base and a collector that are connected to the second end to prevent the current from the supplying means from passing through the transistor and to allow the current based on the counter-electromotive force to pass through the transistor.

15. The compressor according to claim 13, wherein the solenoid has a first terminal and a second terminal, and the transistor includes a source, which is connected to the first terminal, and a gate and a drain, which are connected to the second terminal, to prevent the current from the supplying means from passing through the transistor and to allow the current based on the counter-electromotive force to pass through the transistor.

16. The compressor according to claim 11, wherein the gas passage is included in a supply passage for connecting the discharge chamber with the crank chamber, and the control valve is located in the supply passage for adjusting the amount of the gas introduced into the crank chamber from the discharge chamber through the supply passage to control the pressure in the crank chamber.

17. The compressor according to claim 11 further comprising a shutter member for disconnecting the external circuit from the suction chamber to stop the circulation of the gas between the compressor and the external circuit when the drive plate is positioned in the minimum inclination position.

18. The compressor according to claim 11 further comprising a computer for computing a duty ratio based on the operation state of the compressor, wherein the current supplied by the supplying means varies in accordance with the duty ratio computed by the computer.

19. The compressor according to claim 18, wherein the valve body is movable in the first direction and in a second direction, which is opposite to the first direction, the valve body moves in the first direction to open the gas passage and moves in the second direction to close the gas passage, the solenoid biases the valve body in one of the first direction and the second direction with a force based on the level of the current supplied from the supplying means, and the control valve includes a reacting member for reacting to the pressure of the gas supplied to the compressor from the external circuit, wherein the reacting member moves the valve body in accordance with the pressure of the gas supplied to the compressor from the external circuit.

20. The compressor according to claim 11, wherein the protector is located inside the protecting case and between the connector and a coil of the solenoid.

21. A compressor comprising a drive plate located in a crank chamber and mounted on a drive shaft and a piston operably coupled to the drive plate and located in a cylinder bore, wherein, during operation, the drive plate converts the rotation of the drive shaft to reciprocating movement of the piston in the cylinder bore, wherein the piston compresses gas supplied to the cylinder bore from a separate external circuit by way of a suction chamber and discharges the compressed gas to the external circuit from the cylinder bore by way of discharge chamber, the drive plate inclines between a maximum inclination position and a minimum inclination position according to a difference between the pressure in the crank chamber and the pressure in the cylinder bore, and the piston moves by a stroke determined by the inclination of the drive plate to control the displacement of the compressor, the compressor further comprising:

a gas passage for conducting gas to adjust the difference between the pressure in the crank chamber and the pressure in the cylinder bore; and a control valve for adjusting the amount of the gas flowing in the gas passage, wherein the control valve comprises:

a valve body for adjusting the opening size of the gas passage;

a solenoid selectively excited and de-excited based on a supply of electric current to actuate the valve body; and a protecting case for covering the solenoid, wherein the solenoid generates a counter-electromotive force based on the self-inductance of the solenoid when the solenoid is de-excited;

a driver for supplying the current to the solenoid;

a first detachable connector having a plus and a minus terminal electrically connected to the solenoid;

a second detachable connector electrically connected to the driver for detachably connecting the driver to the first detachable connector; and a protector connected in parallel with the plus and minus terminals of the first detachable connector and with the solenoid, wherein the protector conducts a current based on the counter-electromotive force to prevent the current based on the counter-electromotive force from being supplied to the driver, wherein the protector is located inside the protecting case and between the first detachable connector and a coil of the solenoid.

22. The compressor according to claim 21, wherein the solenoid has a first end and a second end, the protector is connected between the first end and the second end to prevent the current from the driver from passing through the protector and to allow the current based on the counter-electromotive force to pass through the protector, and the protector comprises a diode.

23. The compressor according to claim 21, wherein the protector includes a transistor.

24. The compressor according to claim 23, wherein the solenoid has a first end and a second end, and the transistor includes an emitter, which is connected to the first end, and a base and a collector, which are connected to the second end, to prevent the current from the driver from passing through the transistor and to allow the current based on the counter-electromotive force to pass through the transistor.

25. The compressor according to claim 23, wherein the solenoid has a first end and a second end, and the transistor includes a source, which is connected to the first end, and a gate and a drain, which are connected to the second end, to prevent the current from the driver from passing through the transistor and to allow the current based on the counter-electromotive force to pass through the transistor.

26. The compressor according to claim 21, wherein the gas passage is included in a supply passage for connecting the discharge chamber with the crank chamber, and the control valve is located in the supply passage for adjusting the amount of the gas introduced into the crank chamber from the discharge chamber through the supply passage to control the pressure in the crank chamber.

* * * * *

UNITED STATES PATENT AND TRADEMARK OFFICE

CERTIFICATE OF CORRECTION

PATENT NO. : 6,390,784 B1
DATED : May 21, 2002
INVENTOR(S) : Masahiro Kawaguchi et al.

It is certified that error appears in the above-identified patent and that said Letters Patent is hereby corrected as shown below:

Column 6,
Line 12, change “fixed core 64,. and” to -- fixed core 64, and --.

Column 7,
Line 41, change “the valve, body 54” to -- the value body 54 --.

Column 11,
Line 4, change “Therefore the protector” to -- Therefore, the protector --.

Signed and Sealed this

Twenty-ninth Day of October, 2002

*Attest:*

*Attesting Officer*

JAMES E. ROGAN
*Director of the United States Patent and Trademark Office*